US009679734B2

(12) United States Patent
Cwalina

(10) Patent No.: US 9,679,734 B2
(45) Date of Patent: Jun. 13, 2017

(54) FUSE LINK

(71) Applicant: ABB TECHNOLOGY AG, Zurich (CH)

(72) Inventor: Artur Cwalina, Starachowice (PL)

(73) Assignee: ABB TECHNOLOGY AG, Zurich (CH)

( * ) Notice: Subject to any disclaimer, the term of this patent is extended or adjusted under 35 U.S.C. 154(b) by 0 days.

(21) Appl. No.: 14/923,732

(22) Filed: Oct. 27, 2015

(65) Prior Publication Data

US 2016/0133423 A1 May 12, 2016

(30) Foreign Application Priority Data

Nov. 12, 2014 (EP) ..... 14460090

(51) Int. Cl.
*H01H 85/055* (2006.01)
*H01H 85/17* (2006.01)
(Continued)

(52) U.S. Cl.
CPC ..... *H01H 85/055* (2013.01); *H01H 85/003* (2013.01); *H01H 85/0021* (2013.01);
(Continued)

(58) Field of Classification Search
CPC .. H01H 85/055; H01H 85/17; H01H 85/0021; H01H 85/47; H01H 85/042;
(Continued)

(56) References Cited

U.S. PATENT DOCUMENTS 2,230,207 A * 1/1941 Thommen ..... H01H 85/042 337/139
3,825,870 A * 7/1974 Ono ..... H01H 85/055 29/623
(Continued)

FOREIGN PATENT DOCUMENTS

DE 102005063044 4/2007 ..... H01H 37/76
FR 2 958 073 9/2011 ..... H01H 85/042
(Continued)

OTHER PUBLICATIONS

FR 2958074, 09-2911,—English traslation.*
European Search Report completed Apr. 23, 2015 in corresponding application No. EP 14460090.

*Primary Examiner* — Anatoly Vortman
*Assistant Examiner* — Stephen Sul
(74) *Attorney, Agent, or Firm* — Renner Kenner Greive Bobak Taylor & Weber

(57) ABSTRACT

A fuse link used in alternate current medium- or high-voltage systems with a current frequency of 50 Hz includes a spring-type striker pin and is designed for the protection of electrical devices against consequences of short circuits and overloads. A porcelain housing with a star-core, external end caps closed by plugs, star-core end caps with a ring-shaped first tap designed to ensure electric contact between the star-core end cap and the external end cap of the fuse link is also included. A spring-type striker pin is positioned along the axis of the star-core. Each of the end caps of the star-core is provided with an additional second tap designed to centre the star-core relative to the axis of the fuse link. The spring-type striker pin is centred along the longitudinal axis of the fuse link.

10 Claims, 6 Drawing Sheets

(51) Int. Cl.

| | |
|---|---|
| ***H01H 85/00*** | (2006.01) |
| ***H01H 85/042*** | (2006.01) |
| ***H01H 85/18*** | (2006.01) |
| ***H01H 85/36*** | (2006.01) |
| ***H01H 85/47*** | (2006.01) |
| *H01H 85/30* | (2006.01) |

(52) U.S. Cl.
CPC ..... *H01H 85/042* (2013.01); *H01H 85/17* (2013.01); *H01H 85/185* (2013.01); *H01H 85/36* (2013.01); *H01H 85/47* (2013.01); *H01H 85/306* (2013.01); *H01H 2223/002* (2013.01)

(58) Field of Classification Search
CPC .... H01H 85/185; H01H 85/36; H01H 85/003; H01H 2223/002; H01H 85/306; H01H 9/0044; H01F 2027/404
USPC ..... 337/177, 55, 157, 204, 327
See application file for complete search history.

(56) References Cited

U.S. PATENT DOCUMENTS

| | | | | |
|---|---|---|---|---|
| 3,962,666 | A * | 6/1976 | Knapp, Jr. | H01H 85/157 337/159 |
| 4,029,016 | A * | 6/1977 | Cole | F42C 9/00 102/254 |
| 5,892,427 | A * | 4/1999 | Handcock | H01H 85/042 337/160 |
| 2014/0266561 | A1 * | 9/2014 | Horne | H01H 85/44 337/12 |

FOREIGN PATENT DOCUMENTS

| | | | | |
|---|---|---|---|---|
| FR | 2 958 074 | | 9/2011 | H01H 85/05 |
| FR | 2958074 | A1 * | 9/2011 | H01H 85/306 |
| PL | 66424 | Y1 | 12/2010 | H01H 85/042 |

* cited by examiner

FUSE LINK

TECHNICAL FIELD

The present invention relates to a fuse link used in alternate current medium- or high-voltage systems with a current frequency of 50 Hz, comprising a spring-type striker pin, and designed for the protection of electrical devices against the consequences of short circuits and overloads. The fuse link may be installed both inside the tank of an oil transformer or inside the transformer bushing and in the outdoor or indoor fuse link bases.

BACKGROUND ART

A fuse link is known from the German patent description DE102005063044 that is applicable as a fuse link installed inside the tank of an oil transformer or in the transformer bushing, inside the section immersed in transformer oil. The disclosed fuse link comprises a porcelain housing with a star-core with fuse-elements wound around it and a spring-type striker pin positioned along the axis of the star-core. The housing is filled with an arc-quenching medium and closed on both sides using external end caps, sealed with plugs one of which comprises a pass-through opening in which the striker pin is mounted. The star-core is held inside the fuse link by two star-core end caps designed as rings, each of them provided with a single tap whose function is to ensure electric contact between the star-core end cap and the external end cap of the fuse link. The spring-type striker pin is formed as an internal sleeve closed on its one side and slidably mounted inside an external sleeve that is positioned along the axis of the complete star-core. The internal sleeve is fixed in position along the axis of the external sleeve using a spring that is held in the stretched state by the wire of the internal striker pin so that when the wire is blown, the spring is released and the striker pin is actuated making the closed end of the internal sleeve move along the axis of the fuse link and pass through the outlet opening in the plug of the external end cap that is closed by a flat closing member designed as a ring, positioned on the external surface of the plug and slowing down the longitudinal movement of the external sleeve. The closing member is provided with a centrally located opening or cuts through which the internal sleeve of the striker pin passes. The plug is so designed that its internal flange is bent towards the inside of the fuse link, parallel to the axis of the fuse link which makes it possible to fix the external sleeve outside the flange on the internal side of the plug. The connection of the external sleeve with the plug is sealed using an adhesive sealant and this protects the internal space of the fuse link against penetration of external substances, such as transformer oil. To prevent the oil from entering the internal space of the fuse link, the contact points of the housing ends with the external end caps are sealed from the inside of the end caps and of the housing using a sealing compound. In addition, the sealing compound is applied between the external surfaces of the plugs and the internal surfaces of the end caps.

A disadvantage of the described solution lies in the need to ensure a high value of fit tolerance of the star-core to the star-core end caps. Additionally, in the described solution it is difficult to maintain the central position of the star-core relative to the external end cap of the fuse link due to unilateral support. In the described solution, the spring-type striker pin is fixed to the plug by welding and this requires additional operations during the installation of the striker pin inside the fuse link, and hence is relatively labour-intensive.

The Polish description of a utility model PL.66424Y1 discloses a fuse link comprising a porcelain housing, an insulating star-core with fuse-elements helically wound around it and connected to the electrically conductive first end cap and second end cap of the star-core. The star-core end caps are connected to external end caps of the fuse link that are mounted on the porcelain housing. The fuse link is provided with a spring-type striker pin with a needle unit, the striker pin being positioned along the axis of the fuse link between the first and the second external end caps. The external end caps have axially positioned pass-through openings one of which being closed using a flat closing member designed as a disc. The closing member is designed as a metal membrane permanently fixed to the flat surface of the inside part of the bottom of the second external end cap. The metal membrane is in direct contact with the bent portion of the flange of the striker pin sleeve on the outer side of the flange.

The described solutions fail to provide measures designed to simultaneously centre the star-core relative to the plugs, and the spring-type striker pin relative to one of the plugs.

SUMMARY OF THE INVENTION

The essence of the fuse link according to the present invention is that the fuse link has star-core end caps provided with a second additional tap designed to centre the star-core relative to the axis of the fuse link, such tap being mounted along the circumference of the star-core end cap at an obtuse angle a relative to the first tap. Both taps are provided with spring contacts bent in the direction of the longitudinal axis of the fuse link. The spring-type striker pin is centred along the longitudinal axis of the fuse link using tongues of a disc spring, installed in the plug closing the fuse link on the side where the striker pin is positioned.

Preferably, the taps are provided with a profile plate with the profile of an arc of the tap rim, attached to the edge of the tap.

Preferably, the profile plate is provided with a longitudinally finger that is bent towards the axis of the rim and is designed to ensure electric contact in the current circuit of the fuse link.

Preferably, the plug closing the fuse link on the side opposite to the position of the striker pin in the fuse link has a cavity formed in the external lateral surface of the plug.

Preferably, the external edges of the plug closing the fuse link on the side opposite to the position of the striker pin in the fuse link are in contact with a pressboard spacer separating coolant in the fuse link from the bottom of the plug.

Preferably, the fuse link is provided with a first seal applied along the contact surface between the plug, the disc spring and the housing of the striker pin.

Preferably, the fuse link is provided with a second seal applied along the contact surface between the external end cap and the porcelain housing, and positioned on the external side of the porcelain housing and on the internal side of the end cap on the external edges of the housing.

Preferably, the fuse link is provided with a third seal applied along the contact surface between the external end cap and the porcelain housing, and positioned on the internal side of the porcelain housing and on the internal side of the end cap on the internal edges of the housing.

Preferably, the fuse link is provided with a fourth seal applied between the plug and the external end cap.

Preferably, the fuse link is provided with a fifth seal applied around the clamping sleeve, the insulating bead and the metal housing of the striker pin.

The fuse link according to the present invention is advantageous in that it ensures a concentric position of the star-core relative to the external end caps and the porcelain housing, that the star-core end caps are fixed to the star-core using spring contacts so that precise fitting of components or use of additional binders are avoided, that the striker pin is attached to the plug bottom using a disc spring so that additional welding processes are avoided and the correct mechanical contact ensured, that the seal of the fuse link prevents penetration of the internal space of the fuse link by external substances such as water or transformer oil both prior to fuse link actuation and following its actuation and pushing out of the striker pin.

BRIEF DESCRIPTION OF THE DRAWINGS

The fuse link according to the present invention, used to protect oil transformers, is shown in an exemplary embodiment in the drawing where.

BEST MODE FOR CARRYING OUT THE INVENTION

Figure 4:
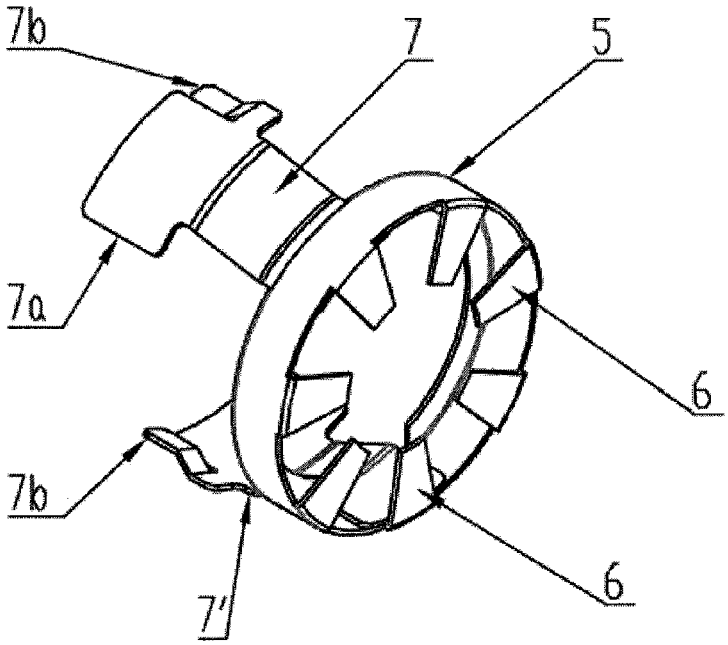
Figure 5:
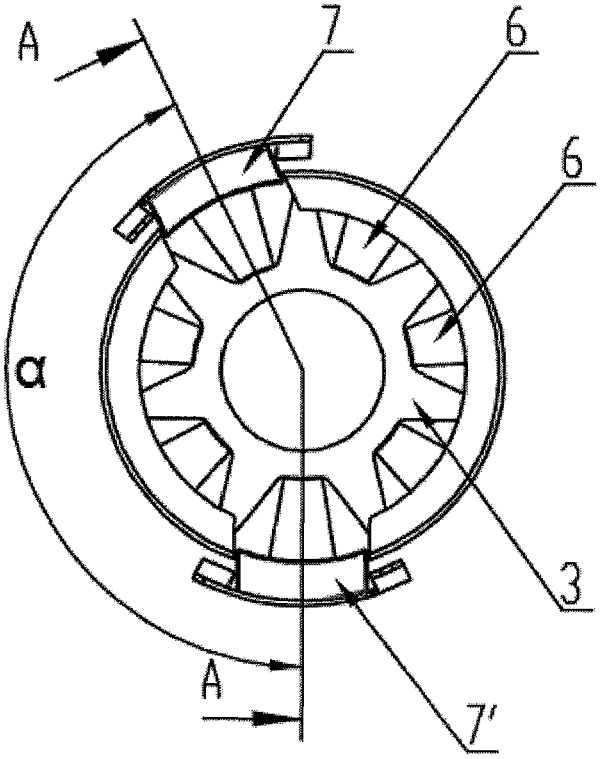
Figure 6:
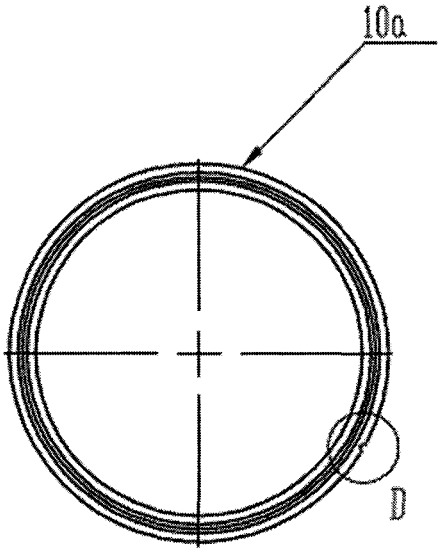
Figure 7:
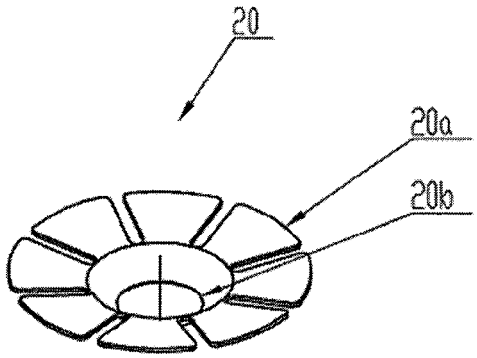
Figure 8:
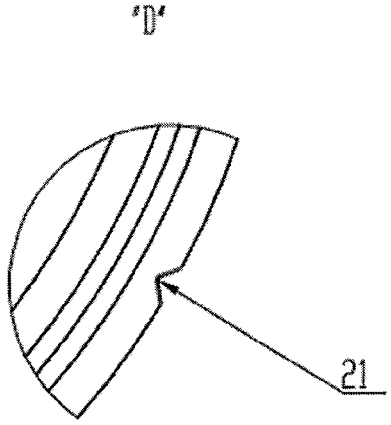
Figure 9:
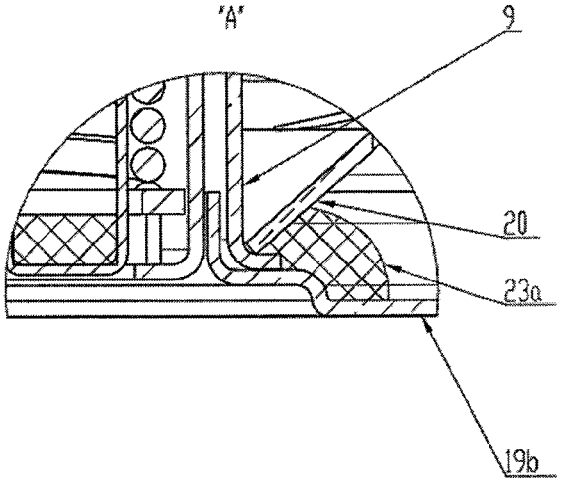
Figure 10:
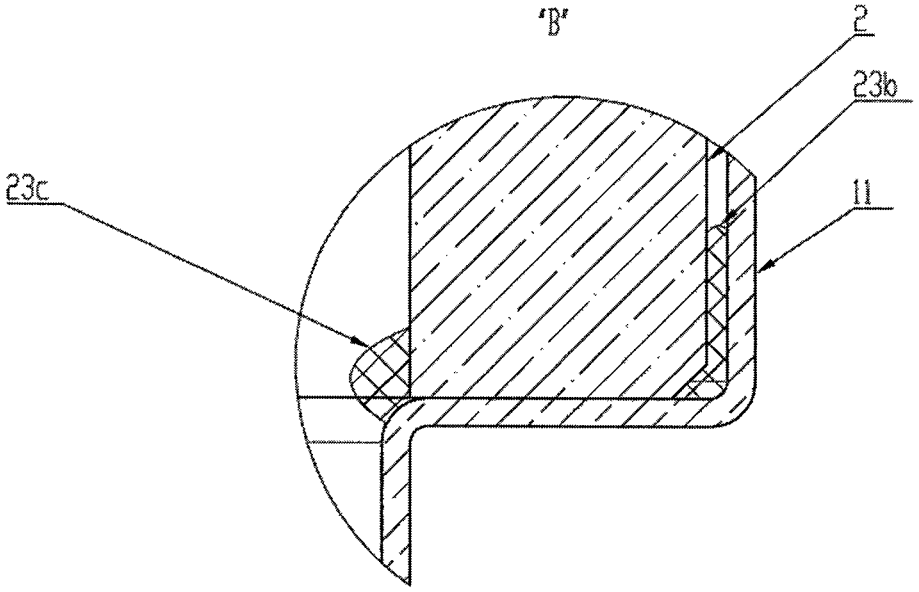
Figure 11:
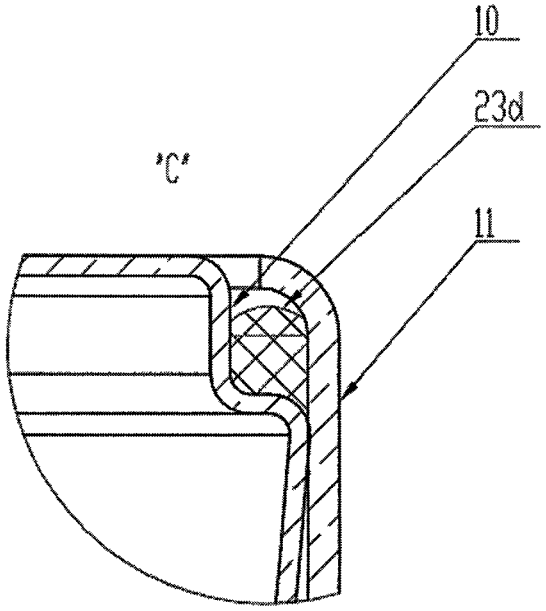

The fuse link 1 used in medium- or high-voltage systems comprising a porcelain housing 2 that contains an insulation star-core 3 with fuse-elements 4 helically wound around it and connected to electrically conductive star-core end caps 5. The star-core end caps 5 are positioned at the ends of the star-core 3 and pressed against the star-core by spring contacts 6 shown in detail in FIG. 4. The star-core end cap 5 is provided with the first tap 7 and the second additional tap 7'. The star-core end cap 5 is rim-shaped and the rim is provided on its one front side with spring contacts 6 that are located around the circumference of one of the edges of the rim and directed towards the centre of the rim. The first tap and the second additional tap 7' are attached to the other side of the rim. Each tap is provided with a profile plate 7*a* with the profile of an arc attached to the other edge of the rim. Each profile plate 7*a* is provided with a longitudinal finger 7*b* that is bent towards the axis of the rim and is designed to ensure electric contact. The taps 7, 7' are located on the circumference of the rim at an obtuse angle $\alpha$, depending on the shape of the star-core 3. The spring-type striker pin 8 is positioned at one end of the fuse link and contains a metal housing 9 with a graded diameter. The fuse link is closed on its both sides using the first metal plug 10*a* and the second metal plug 10*b*. The plug 10*b* contains the centrally positioned striker pin 8. The external end caps 11 are attached to the housing 2 whose internal space is filled with a coolant that is not depicted in the Figure. The section of the metal housing 9, which may be in the form of a sleeve, characterised by a larger diameter contains an axially positioned internal sleeve 12 whose ends are shaped as flanges 12*a* and 12*b* of which the flange 12*a* is bent towards the centre of the sleeve and located on the contact surface of the sleeve 12 with the plug 10. The second flange 12*b* is bent to the outside of the sleeve 12 and rests on an internal projection formed in the housing 9 in its section where the housing tapers to a smaller diameter. The housing 9 is provided with an external flange bent to the outside of the section characterised by a larger diameter and the flange is connected to the plug 10.

Inside the sleeve 12 and inside the section of the housing characterised by a smaller diameter of the metal housing 9, a tension spring 13 is mounted whose one end rests on the auxiliary washer 14 positioned inside the sleeve 12 next to the flange 12*a*. The purpose of the washer 14 is to ensure correct support for the thermal washer 15 used to hook on it the internal wire 16 that maintains the stretched state of the spring 13 and is attached at its one end to the tension spring 13 and at its other end to the clamping sleeve 17 that is positioned on the insulating bead 18 that is attached to the end of the metal housing 9.

The plug 10*a* is formed as two rings with various diameters of which the ring with a smaller diameter is closed using the bottom 19*a*. The plug 10*b* is formed as two rings with various diameters of which the ring with a smaller diameter is closed using the bottom 19*b* with a concentric opening for the striker pin 8 which is not depicted in the Figure. Inside the plug 10*b*, the disc spring 20 is mounted with the shape of a conical sleeve 20*b* containing tongues 20*a* located along the circumference of the conical sleeve 20*b* characterised by a larger diameter. The disc spring 20 is pressed on one side by the edges of the opening in the sleeve 20*b* with a smaller diameter against the bent section of the housing 9, and on the other side is pressed by the tongues 20*a* to the internal walls of the larger ring of the plug 10*b*. The external walls of the larger ring of the plug 10*a* have a cavity 21 used to equalize the internal pressure inside the fuse link and the external pressure. The external edges of the larger ring of the plug 10*a* are in contact with the pressboard spacer 22 separating the coolant from the plug 10*a*.

Figure 1:
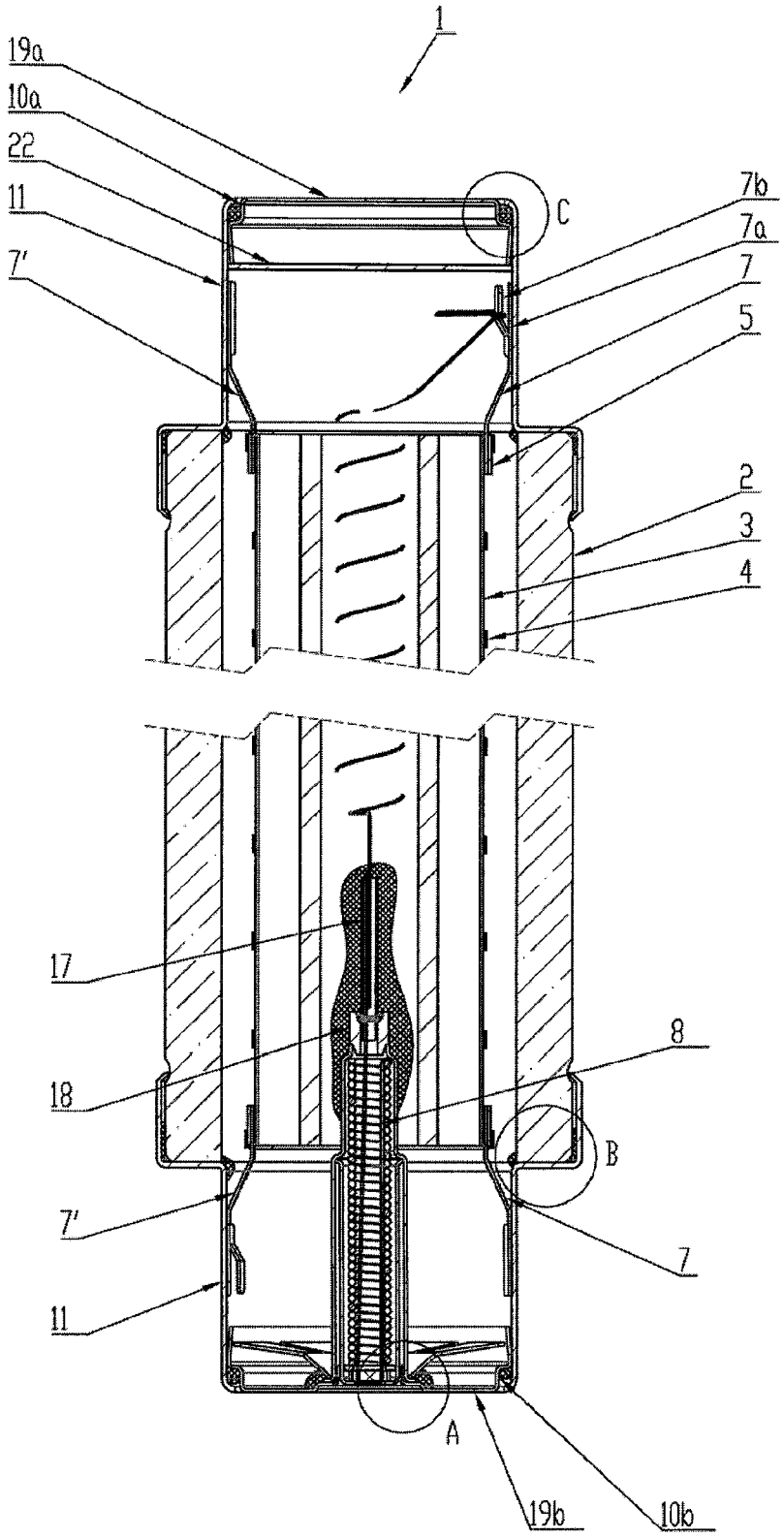
FIG. 1—shows the fuse link in its longitudinal section.
Figure 2:
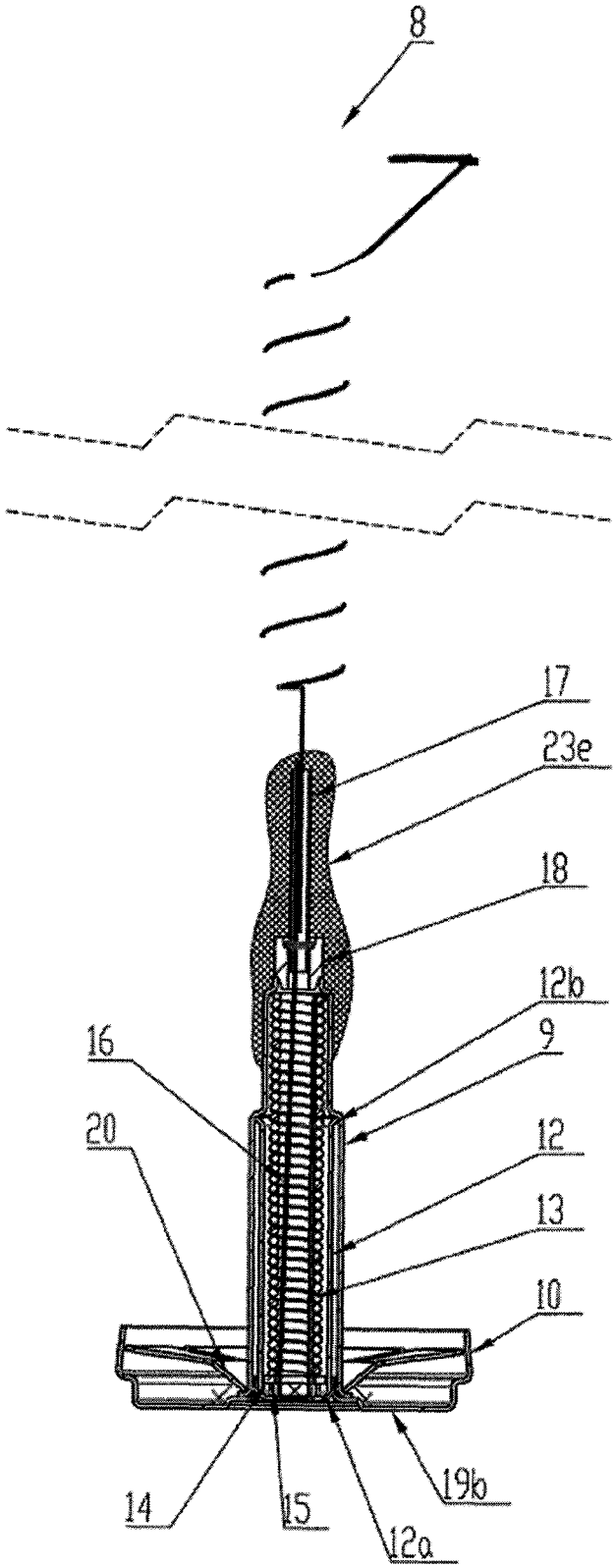
FIG. 2—shows the spring-type striker pin in its longitudinal section.
Figure 3:
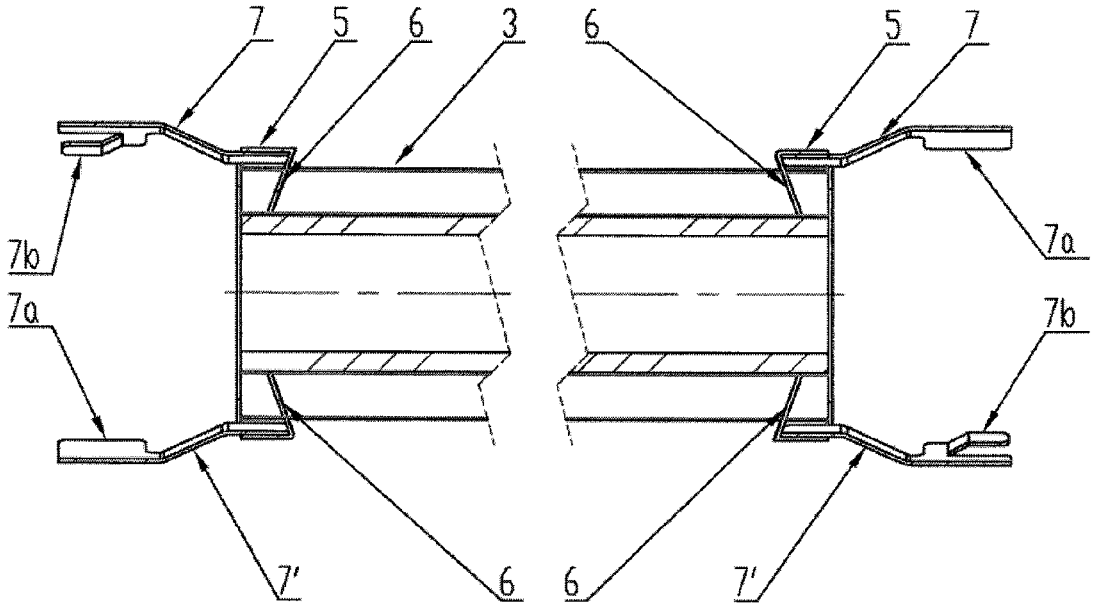
FIG. 3—shows the end caps of the star-core positioned at the ends of the star-core, in a longitudinal section, FIG. 4—shows the end cap of the star-core in an isometric projection, FIG. 5—shows the end cap of the star-core with the star-core in a front view, FIG. 6—shows the plug in a front view, FIG. 7—shows the disc spring in an isometric projection, FIG. 8—shows the detail "D" from FIG. 6 in a front view, FIG. 9—shows the detail "A" from FIG. 1, in a longitudinal section, FIG. 10—shows the detail "B" from FIG. 1, in a longitudinal section, FIG. 11—shows the detail "C" from FIG. 1, in a longitudinal section.

The fuse link 1 is provided with seals 23 made from adhesive sealant. The first seal 23*a* is applied along the contact surface between the bottom 19*b*, the disc spring 20 and the housing 9 of the striker pin 8. The second seal 23*b* is applied along the contact surface between the external end cap 11 and the porcelain housing 2 on the external side of the housing 2 and on the internal side of the end cap 11 on the external edges of the housing 2. The third seal 23*c* is applied along the contact surface between the external end cap 11 and the porcelain housing 2 on the internal side of the housing 2 and on the internal side of the end cap 11 on the internal edges of the housing 2. The fourth seal 23*d* is applied between the plug 10*a* and the external end cap 11. The fifth seal 23*e* is applied around the clamping sleeve 17, the insulating bead 18 and the metal housing of the striker pin 9, as depicted in FIG. 2. The purpose of the adhesive sealant is to prevent external substances from penetrating the internal space of the fuse link.

The current circuit of the fuse link consists of the external end cap 11, the tap 7, the star-core end cap 5, the fuse-elements 4, the star-core end cap 5, the tap 7 and the external end cap 11. The operation of the fuse link 1 consists in switching off and limiting short-circuit or overload currents by blowing the fuse-elements 4 of the fuse link 1, and then by blowing the internal wire 16 of the spring-type striker pin

8 which releases the tension spring 13 and consequently pushes out the sleeve 12 of the spring-type striker pin 8 and breaks the current circuit. The protruding sleeve 12 of the striker pin 8 also provides a signal of fuse link actuation and may be used to actuate a switch that is not depicted in the Figure.

A List of Marks Used in the Figure.

1—Fuse link
2—Porcelain housing
3—Star-core
4—Fuse-elements
5—Star-core end caps
6—Spring contacts
7—Tap, 7' Additional Tap (7*a*—profile plate, 7*b*—finger)
8—Spring-type striker pin
9—Metal housing of the striker pin
10—Plug (10*a*, 10*b*)
11—External end caps
12—Slidable internal sleeve of the striker pin (sleeve flanges 12*a*, 12*b*)
13—Tension spring
14—Auxiliary washer
15—Thermal washer
16—Internal wire
17—Clamping sleeve
18—Insulating bead
19—Bottom of the plug (19*a*, 19*b*)
20—disc spring (20*a* spring tongue, 20*b* conical sleeve)
21—Cavity in the plug
22—Pressboard spacer
23—Seal (23*a*, 23*b*, 23*c*, 23*d*, 23*e*)

What is claimed is:

1. A fuse link comprising a porcelain housing with a star-core with wound fuse-elements, external end caps closed by plugs, star-core end caps with a ring-shaped first tap designed to ensure electric contact between the end cap of the star-core and the external end cap of the fuse link, and a spring-type striker pin positioned along the axis of the star-core, characterised in that each of the star-core end caps is provided with a second tap that is designed to centre the star-core relative to the axis of the fuse link and is located on the circumference of the star-core end cap at an obtuse angle ($\alpha$) relative to the first tap, measured in a plane perpendicular to the axis of the fuse link, wherein said first and the second taps extend radially outward and axially away from a first edge of said star-core end cap and are provided with spring contacts bent inwardly from a second edge of said star-core end cap towards the direction of the longitudinal axis of the fuse link and in electrical contact with the wound fuse elements, and the spring-type striker pin is radially centred along the longitudinal axis of the fuse link by tongues of a disc spring that is mounted in one of the plugs closing the fuse link on the side where the spring-type striker pin is positioned.

2. The fuse link according to claim 1, characterized in that the taps are provided with a profile plate extending from the star-core end cap which is rim-shaped, wherein the profile pate has an arc shape of a tap rim, that is attached to the edge of the external end cap.

3. The fuse link according to claim 2, characterized in that the profile plate is provided with a longitudinal finger that is bent from the profile plate toward the axis of the tap rim.

4. The fuse link according to claim 1, characterised in that the plug closing the fuse link on the side opposite to the position of the striker pin in the fuse link is provided with a cavity formed in the external lateral surface of the plug used to equalize pressure inside the fuse link with external pressure.

5. The fuse link according to claim 1, characterised in that the external edges of the plug closing the fuse link on the side opposite to the position of the striker pin in the fuse link are in contact with a pressboard spacer for separating a coolant filling an internal space of the porcelain housing and said external end cap from a bottom of the plug.

6. The fuse link according to claim 1, characterised in that it comprises a first seal that is applied along the contact surface between the plug, the disc spring and a housing of the striker pin.

7. The fuse link according to claim 6, characterised in that it comprises a second seal that is applied along the contact surface between the external end cap and the porcelain housing, and is positioned on the external side of the porcelain housing and the internal side of the end cap on the external edges of the porcelain housing.

8. The fuse link according to claim 7, characterised in that it comprises a third seal that is applied along the contact surface between the external end cap and the porcelain housing, and is positioned on the internal side of the housing and the internal side of the end cap on the internal edges of the porcelain housing.

9. The fuse link according to claim 8, characterised in that it comprises a fourth seal that is applied between the plug and the external end cap.

10. The fuse link according to claim 9, characterised in that it comprises a fifth seal that is applied around a clamping sleeve, an insulating bead and a metal housing of the striker pin.

* * * * *